US006510779B2

(12) United States Patent
Greene et al.

(10) Patent No.: US 6,510,779 B2
(45) Date of Patent: Jan. 28, 2003

(54) ELECTRONIC BORE PRESSURE OPTIMIZATION MECHANISM

(75) Inventors: Dennis M. Greene, Ames, IA (US); Jeff L. Herrin, Ankeny, IA (US)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 09/801,300

(22) Filed: Mar. 7, 2001

(65) Prior Publication Data

US 2002/0106283 A1 Aug. 8, 2002

Related U.S. Application Data

(63) Continuation-in-part of application No. 09/776,554, filed on Feb. 2, 2001, now Pat. No. 6,413,005.

(51) Int. Cl.[7] ..... F01B 3/10
(52) U.S. Cl. ..... 91/504; 417/270; 91/505
(58) Field of Search ..... 417/269, 270, 417/279, 440; 91/505, 504, 499, 12.2

(56) References Cited

U.S. PATENT DOCUMENTS 3,585,901 A 6/1971 Moon, Jr. et al.
4,550,645 A 11/1985 Beck, Jr.
5,160,245 A 11/1992 Geringer
5,423,183 A 6/1995 Folsom
5,486,142 A 1/1996 Folsom
5,493,862 A 2/1996 Folsom
5,535,589 A 7/1996 Folsom
5,554,007 A * 9/1996 Watts ..... 417/222.1
5,575,152 A 11/1996 Folsom
5,678,405 A 10/1997 Folsom
6,119,456 A 9/2000 Louis et al.

* cited by examiner

*Primary Examiner*—Charles G. Freay
*Assistant Examiner*—Emmanuel Sayoc

(57) ABSTRACT

An electronic bore pressure optimization mechanism for dynamically varying the cylinder block piston bore pressure profile in a multiple piston hydraulic unit includes a valve means having a variable orifice disposed in the end cap for metering fluid between leading and trailing pistons in a transition region or between a piston in a transition region and a high or low pressure source; and means for generating a control error signal to the valve means so as to adjust the size of the variable orifice based upon the control signal.

11 Claims, 4 Drawing Sheets

ELECTRONIC BORE PRESSURE OPTIMIZATION MECHANISM

CROSS-REFERENCE TO RELATED APPLICATIONS

This application is a continuation-in-part (CIP) of U.S. patent application Ser. No. 09/776,554 filed Feb. 2, 2001, now U.S. Pat. No. 6,413,005

BACKGROUND OF THE INVENTION

The present invention relates to the field of hydraulics. More particularly, this invention relates to an electronic bore pressure optimization mechanism for altering the cylinder block piston bore pressure profile. The bore pressure profile has a direct impact on the noise, vibration, efficiency, and forces required to position the swashplate in a hydrostatic unit such as pump or motor. In general, the mechanism can be used to control any system variable, including but not limited to noise, vibration, flow ripple, pressure ripple, efficiency and/or the force and energy levels required to position the swashplate in axial piston pumps and motors. The mechanism is particularly useful in applications where operator "feel" is important, allowing the operator to feel feedback from the vehicle but at reduced force levels. The mechanism is also useful in applications where system noise or sound level is important, allowing the reduction of noise in environments where sound levels must be regulated. The mechanism provides a dynamic or variable method of affecting or tuning net swashplate moments, sound, vibration, and/or efficiency.

"Feel" could be associated with almost any variable that can be sensed, including but not limited to: noise, control forces (power level), and flow ripple. Flow ripple is a well known and common phenomenon in multiple piston hydrostatic units. For instance, in an axial piston hydrostatic unit, the total average flow produced or consumed by a hydrostatic pump or motor is the sum over time of the flows produced or consumed by the individual pistons as they reciprocate when the cylinder block rotates. But the pistons are spaced apart along a pitch circle and are therefore phased in time such that the flow varies somewhat during each rotation of the cylinder block. The flow ripple comprises these variations in flow or deviations in amplitude from the average flow of fluid produced or consumed by the hydrostatic unit.

Hydrostatic transmissions have been used in skid steer loaders for a number of years now. In the early days of hydrostatically propelled skid steer loaders, the machines were relatively small and therefore the operator could manually control the position of the swashplate through mechanical linkage with minimal force and fatigue. The operator could also directly feel a feedback force from the swashplate. The energy or power to control the swashplate came solely from the operator. As the machines have become larger in recent years, the power and force levels have become too large for the operator to tolerate without tiring when operating the machine for an extended period of time.

Servo-controlled transmissions were developed to overcome the operator fatigue problem, but the operators then felt "disconnected" from the machine when attempting to control its displacement or swashplate position. The servo control devices require additional power and suffer reduced response capability, especially when response is needed most such as when the machine is near neutral, has low displacement, or is inching.

Various tiltable swashplate arrangements are known for varying displacement in axial piston pumps and motors. In one arrangement, the swashplate has opposite cylindrical trunnions that pivotally mount or journal it in the pump or motor housing. A plurality of pistons slidably mount in corresponding piston bores or chambers arranged in a circular pattern in a rotatable cylinder block that is urged by a block spring toward the tiltable swashplate. A valve plate engages the end of the cylinder block that is remote from the swashplate. Slippers swivelingly attached to the pistons engage a running surface on the swashplate as the cylinder block rotates. If the running surface of the swashplate is perpendicular to the longitudinal axes of the pistons, the pistons do not reciprocate in the cylinder block and no fluid is displaced or consumed by the hydraulic unit. A lubrication hole typically extends longitudinally through the piston and slipper so that oil from the piston bore or chamber can reach the slipper running surface of the swashplate.

When the swashplate is forcibly tilted away from perpendicular, the pistons reciprocate in the piston bores as the pistons are driven in a circle against the inclined plane. This reciprocating action means that the chambers of the pistons on one region of the swashplate are under high pressure, while the piston chambers on the opposite region of the swashplate are under low pressure. Each piston bore or chamber in the cylinder block has a "pressure profile" associated with it as the block rotates. The pressure acting on the cross-sectional area of the piston translates into a force, which yields a moment on the swashplate. To move or maintain the swashplate tilted to given degree, a moment of equal and opposite magnitude must be maintained on the swashplate. The operator does this manually by applying a force on a lever or torque on a handle attached to the swashplate or through a conventional servo mechanism. If a servo mechanism is used, operator "feel" is usually lost.

One common method of fine tuning or affecting swashplate moments in a hydrostatic unit is a static method involving designing a specific valve plate with a specific fixed porting configuration to achieve the desired swashplate moments. A valve plate is a substantially flat disc-shaped annular ring of material that is fixed against rotation on the end cap of the hydraulic unit adjacent the rear surface of the rotating cylinder block (which is opposite of the swashplate). The conventional valve plate typically has an arcuate inlet port and an arcuate outlet port formed therethrough on opposing sides of a median axis. These ports reside along arcs that generally align with the pitch circle of the piston bores in the cylinder block. Thus, the inlet and outlet ports generally register with the circular path of the reciprocating pistons as the pistons rotate with the cylinder block against the valve plate. The inlet and outlet ports are angularly spaced apart in the areas or zones where the reciprocating pistons change their direction of reciprocal movement or transition from high pressure to low pressure and vice versa. The top dead center (TDC) and bottom dead center (BDC) positions of the reciprocating pistons generally correspond to these transition zones. The spacing of the inlet and outlet ports of the valve plate depends to some extent on the number of pistons in the rotating cylinder block assembly.

Some existing valve plates utilize specially shaped notches, such as "rat tails" or "fish tails," at the entrance and/or exit of the ports (i.e.—in the transition zones) to affect the swashplate moments. Moon et al. U.S. Pat. No. 3,585,901 teaches the basics of utilizing valve plate fish tails to affect swashplate moments in axial piston hydraulic units. U.S. Pat. No. 4,550,645 teaches some additional geometric configurations for fish tails and valve plates. Unfortunately, many different valve plates are required to satisfy the swashplate moment demands of the various users. Thus, the number of valve plate designs tends to proliferate and it can be costly to produce and warehouse an adequate selection of valve plates. Furthermore, if a change in swashplate moments is desired, the user must physically disassemble the unit and change the valve plate. Finally, the valve plate configuration is essentially constant or static once a particular valve plate is selected and installed. A valve plate configuration may have beneficial effects on the swashplate moments, performance and controllability of the unit under certain operating conditions (including but not limited to speed, pressure and displacement), but the same valve plate configuration may have undesirable effect under other conditions within the normal operating range of the unit. Since the valve plate geometry is fixed based upon the valve plate chosen, the user must accept the tradeoffs involved. Careful and elaborate optimization analysis is often required to determine the best valve plate design for the task.

Thus, there is a need for dynamic rather than static means and methods for affecting swashplate moments. There is also a need for a means and method for affecting swashplate moments that does not necessarily involve valve plate design changes or valve plate proliferation.

Crawlers are large machines that utilize servo systems to control the position of the swashplate. The size of the servo systems can become quite bulky or require high control pressure, limiting the response of the swashplate. Thus, there is a need for a means for reducing the power requirements of the servo system, allowing smaller servo systems and/or lower control pressures.

In the mobile hydraulic market increasing demands are being made for lower noise, lower flow ripple and higher efficiency. In the past, one selected from among a variety of valve plates having fixed porting designs to control the power level requirements for positioning the swashplate. Sacrifices in noise, flow ripple and efficiency were made to achieve the desired power requirements. Thus, there is a need for a means for controlling the power level requirements while optimizing noise, flow ripple and efficiency.

Therefore, a primary objective of the present invention is the provision of a dynamic means and method for affecting the cylinder block piston bore pressure profile in a hydrostatic unit.

Another objective of this invention is the provision of a variable means of affecting swashplate moments throughout the normal operating range of operating conditions of the hydraulic unit.

Another objective of this invention is the provision of a means for reducing net swashplate moments in a manually controlled hydraulic unit to reduce operator fatigue without sacrificing the feel of operator feedback.

Another objective of this invention is the provision of a means for generating a control error signal to a variable orifice valve for bleeding fluid between adjacent pistons to affect bore pressure and subsequently swashplate moments.

Another objective of this invention is the provision of means for varying swashplate moments without the need for changing valve plates in a hydraulic unit.

Another objective of this invention is the provision of a method for optimizing piston bore pressures that allows the operator to feel connected to the machine while reducing the power level requirement from the operator.

Another objective of this invention is the provision of a method of reducing power requirements that is also applicable to servo-controlled units so as to allow smaller servo systems and/or control pressures.

Another objective of this invention is the provision of a means for controlling the power level requirements while optimizing noise, flow ripple and efficiency.

Another objective of this invention is the provision of a means for controlling a system variable, including but not limited to pressure ripple, flow ripple, noise, vibration, efficiency, and/or control force or power requirements. An example is a means for reducing the noise level in a hydraulic unit at all operating conditions regardless of moment levels.

These and other objectives will be apparent from the drawings, as well as from the description and claims that follow.

SUMMARY OF THE INVENTION

The present invention relates to an electronic bore pressure optimization mechanism for dynamically varying swashplate moments in a multiple piston hydraulic unit. The mechanism includes a variable orifice associated with a bleed passage in the end cap or center section of the hydraulic unit. The fluid passage comes into communication with the block kidneys of individual piston bores as the piston bores move along the pitch circle and through the transition area during rotation of the cylinder block. The variable orifice effectively resides between a first piston or pressure source and an adjacent transitioning pumping/motoring piston. The mechanism utilizes one or more sensed parameters from a group including but not limited to noise, pressure, speed, swashplate position, swashplate control requirements, vibration, and operator input to electronically control the variable orifice and thereby meter the flow of fluid to and from the transitioning pistons. The mechanism can be associated with the low pressure source side of the loop or the high pressure source side of the closed circuit loop. Optionally, a valve plate can be positioned between the end cap and the cylinder block and provided with a non-limiting fluid passage that connects the block kidney and the bleed passage in the end cap.

The invention adapts equally well to manually controlled units and servo-assisted units.

DETAILED DESCRIPTION OF THE PREFERRED EMBODIMENT(S)

Figure 1:
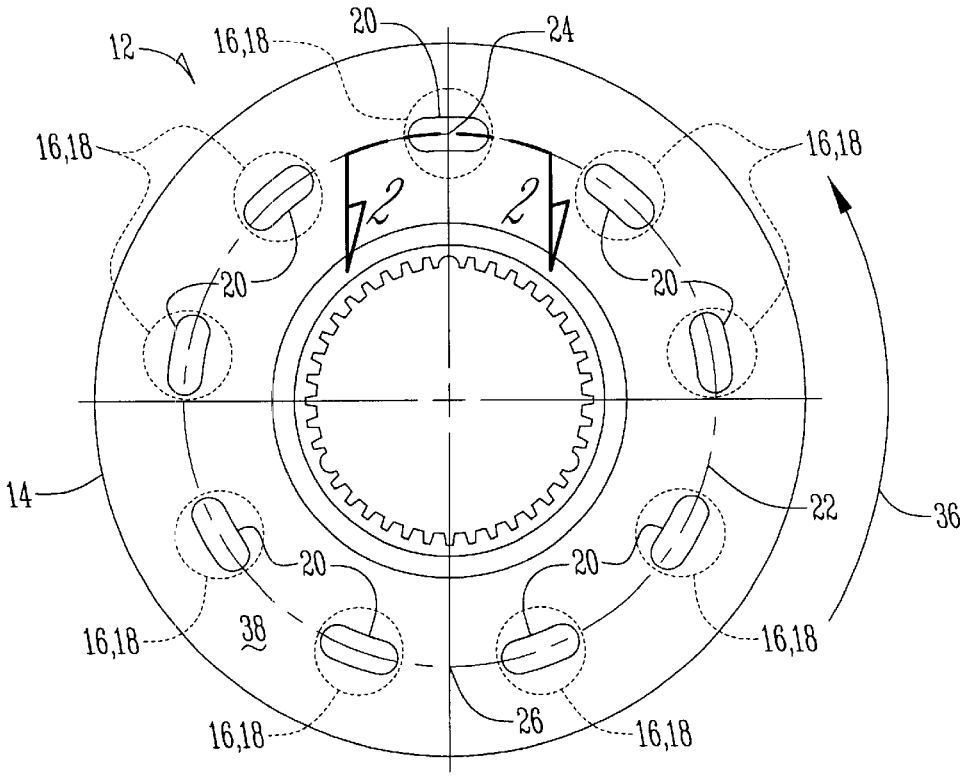
FIG. 1 is a plan view taken along line 1—1 in FIG. 2 of the scaling or running surface on the bottom of the cylinder block of this invention.

The electronic bore pressure optimization mechanism 10 of this invention adapts well to conventional axial piston hydrostatic units such as pumps or motors. In a first embodiment shown in FIGS. 1–5, the axial piston hydrostatic unit includes a rotatable cylinder block assembly 12. The cylinder block assembly 12 includes an elongated, substantially cylindrical cylinder block 14 that has a plurality of piston bores 16 formed axially therein for receiving a corresponding plurality of axially reciprocating pistons 18. The piston bores 16 may extend completely through the cylinder block 14, but more preferably are blind bores intersected by arcuate block kidneys 20 as shown.

Figure 2:
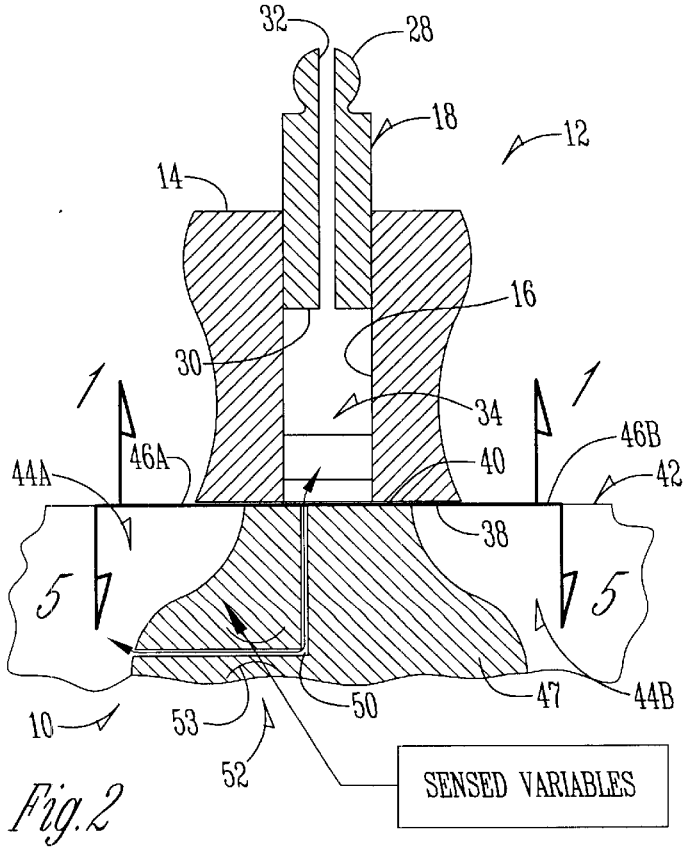
FIG. 2 is a sectional view taken along line 2—2 in FIG. 1 and shows the cylinder block, piston, end cap and variable orifice of this invention.
Figure 3:
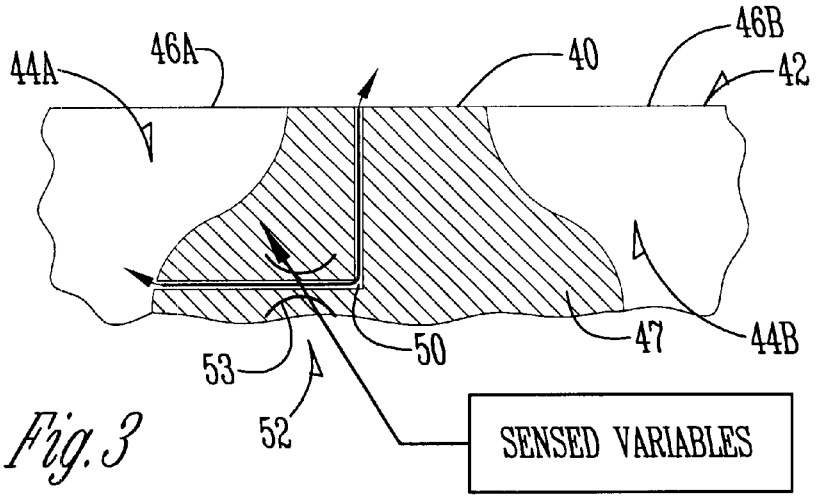
FIG. 3 is a sectional view of the end cap of this invention taken along the pitch circle and through the fluid passage.
Figure 4:
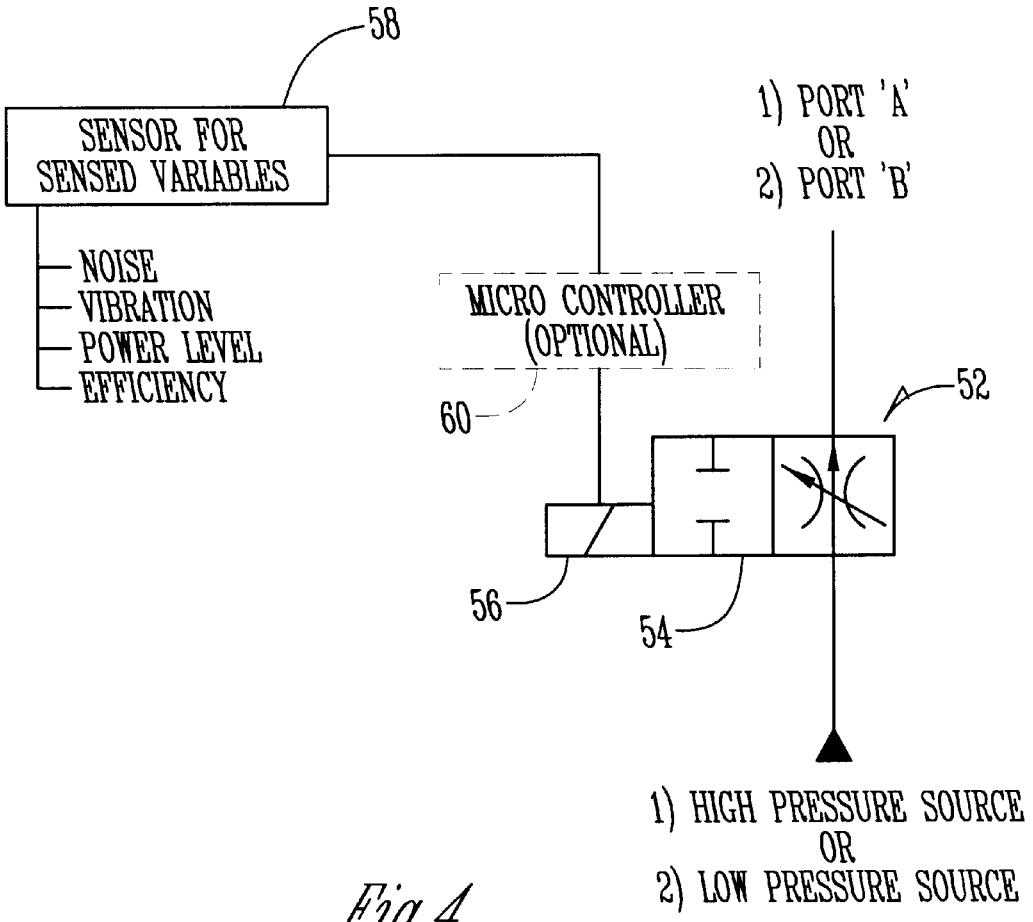
FIG. 4 is a simplified schematic diagram depicting the electrical and hydraulic components of this invention.
Figure 5:
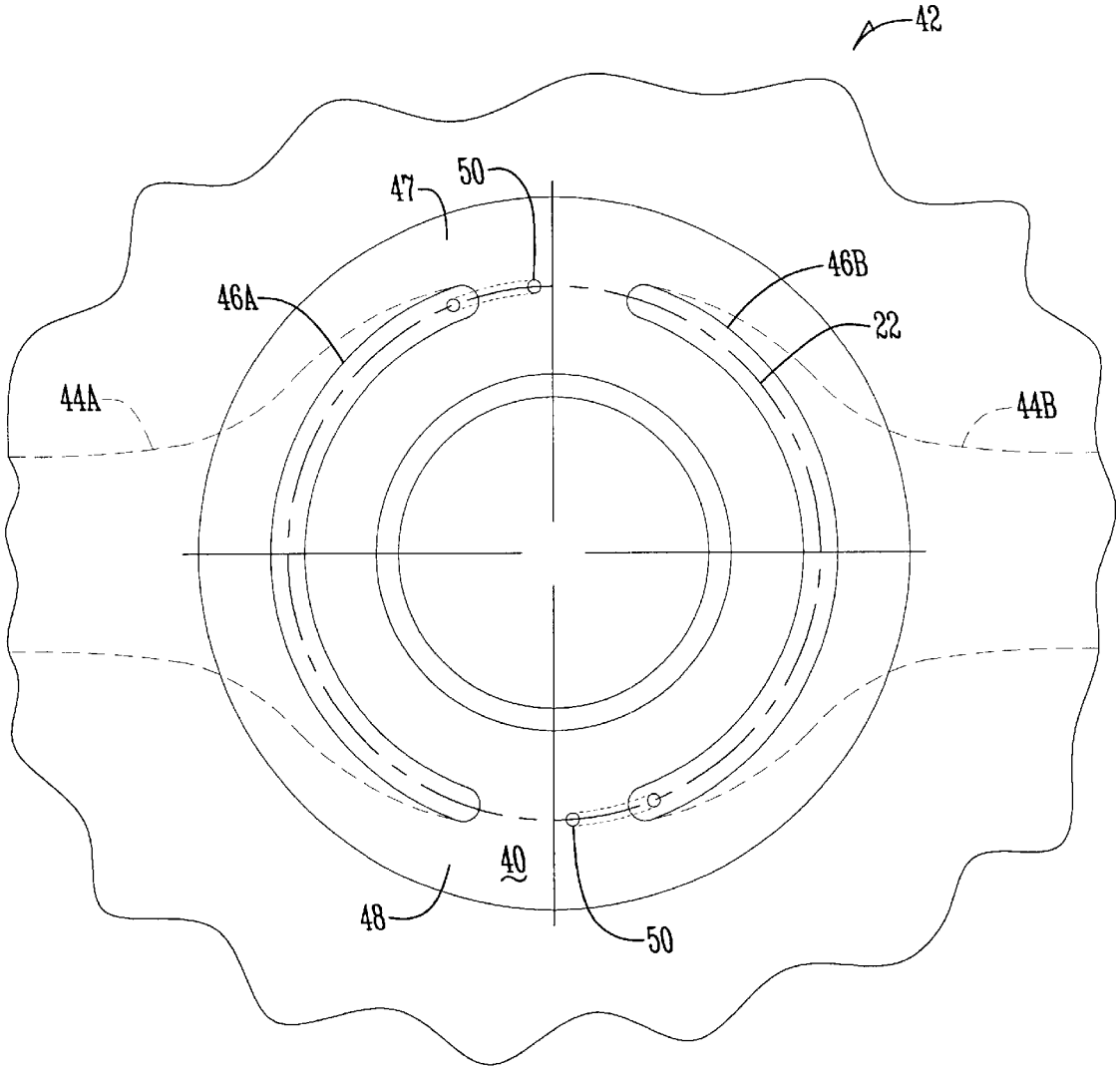
FIG. 5 is a partial top plan view of the end cap of this invention.

As the cylinder block assembly 12 rotates, the pistons 18 move along a circular path known as the pitch circle 22 and reciprocate within their respective bores 16. The pistons 18 reach their maximum extension at a top dead center (TDC) position 24 and their maximum insertion into the block at a bottom dead center (BDC) position 26. The pistons 18 are preferably elongated and have an upper end 28 and a lower end 30 as shown in FIG. 2. A lubrication passage 32 conventionally extends axially through the piston. The passage 32 allows a small amount of oil to escape from the piston bores 16 to lubricate the pistons 18 and/or slippers (not shown) as they rotate and bear against a planar surface on a swashplate or displacement control means (not shown) in the hydrostatic unit.

As is well known in the art of hydrostatics, the swashplate can be fixed at a given angle for a fixed displacement hydrostatic unit or can be pivotally mounted and movable through a given range of angles for a variable displacement unit. The angle of the inclined plane determines how far the pistons 18 reciprocate and thus how much fluid is displaced or consumed by the pump or motor. During reciprocation, each pumping or motoring piston 18 establishes a fluid pressure chamber 34 in the cylinder block 14. The volume of the chamber 34 varies cyclically as the piston moves around the pitch circle. Adjacent pistons 18 either lead or trail each other as they move around the pitch circle 22. For example, when the cylinder block 14 rotates in the direction shown by the arrow 36 in FIG. 1, the piston in the top dead center position 24 leads the piston to its right and trails the piston to its left.

The end of the cylinder block 14 opposite the end from which the pistons extend is commonly referred to as a running or sealing surface 38. The sealing surface 38 of the cylinder block 14 sealingly engages a block mounting surface 40 on an end cap 42. As is well known in the art, a pair of separate working pressure passages 44A, 44B extend through the end cap 42. The working pressure passages 44A, 44B terminate respectively at corresponding first and second ports 46A, 46B on the block mounting surface 40. Although many shapes are possible without detracting from the invention, the ports 46A, 46B are preferably arcuately shaped. The ports 46A, 46B have opposite ends separated or spaced apart by intervening walls 47, 48. The basic structure of the axial piston hydraulic unit as described above is conventional.

However, in the present invention, one or more of the walls 47, 48 between the ports 46A, 46B in the end cap 42 includes a bleed passage 50 formed therethrough. The bleed passage 50 begins at the block mounting surface 40, is encircled by or extends through the interior of the end cap 42, and intersects one of the working pressure passages 44A, 44B remote from their respective ports 46A, 46B. Of course, while the bleed passage 50 is in fluid communication with one of the pistons 18, the ports 46A, 46B are in fluid communication with the adjacent pistons. Thus, the bleed passage 50 interconnects a leading piston and a trailing piston. Preferably the bleed passage 50 has a round cross section because such a cross section is easy to form by drilling, boring, or coring with a cylindrical core pin in a conventional casting operation. However, other cross sectional shapes are possible.

In FIGS. 1–5, a bleed passage 50 is shown extending through both walls 47, 48 of the end cap and into both of the working pressure passages 44A, 44B. This provides symmetrical operating characteristics or at least the ability to control operating characteristics in both pressure transition areas. However, a single bleed passage could be utilized to affect the pressure transition in only one of the areas. The bleed passage could also be on the opposite side of top or bottom dead center and exit into the opposite working pressure passage than the one shown.

A variable orifice valve means 52 is operatively associated with the bleed passage 50 of the end cap 42. In one embodiment, the variable orifice valve means 52 can be schematically represented as a two position solenoid operated valve 54 having a first position in which flow through the bleed passage 50 is completely blocked, and a second position in which the flow of fluid through the bleed passage 50 is metered in a variable and controlled manner. See FIG. 4. The flow of fluid through the variable orifice valve means 52 is preferably directly proportional to the signal applied to the solenoid 56.

The solenoid 56 receives a signal from a sensor 58 that is associated with the hydrostatic unit. The sensor 58 can be of the proportional or non-proportional type. The sensor 58 can be a microphone to pick up noise emanating from the unit. The sensor 58 could also be adapted to pick up other system variables of the unit, such as vibration, power level requirements, or volumetric efficiency. The sensor 58 could also be adapted to pickup operating condition variables of the unit such as pressure, speed, or swashplate angle. The signal generated by the sensor 58 can be transmitted directly to the solenoid of the variable orifice valve means or an optional microcontroller or microprocessor 60 can be inserted between the sensor 58 and the solenoid 56 to perform any necessary amplification, conversion or conditioning of the signal before it reaches the solenoid.

The bleed passage 50 and the variable orifice valve means 52 thus combine to meter flow to and from leading and trailing pistons 18 as they move through the pressure transition zones between the ports 46A, 46B. This allows optimization of the porting of fluid into and out of the pumping and/or motoring pistons bores in an axial piston pump or motor. Porting optimization is dependent upon operating conditions and a desired parameter upon which control is based, for example, noise, vibration, power level requirement, pressure, speed, swashplate angle, and/or the efficiency of the unit. The electronic bore pressure optimization mechanism 10 of this invention has been described above in its simplest form. This embodiment is useful when the maximum displacement and working pressure requirements of the hydrostatic unit are relatively low.

Figure 6:
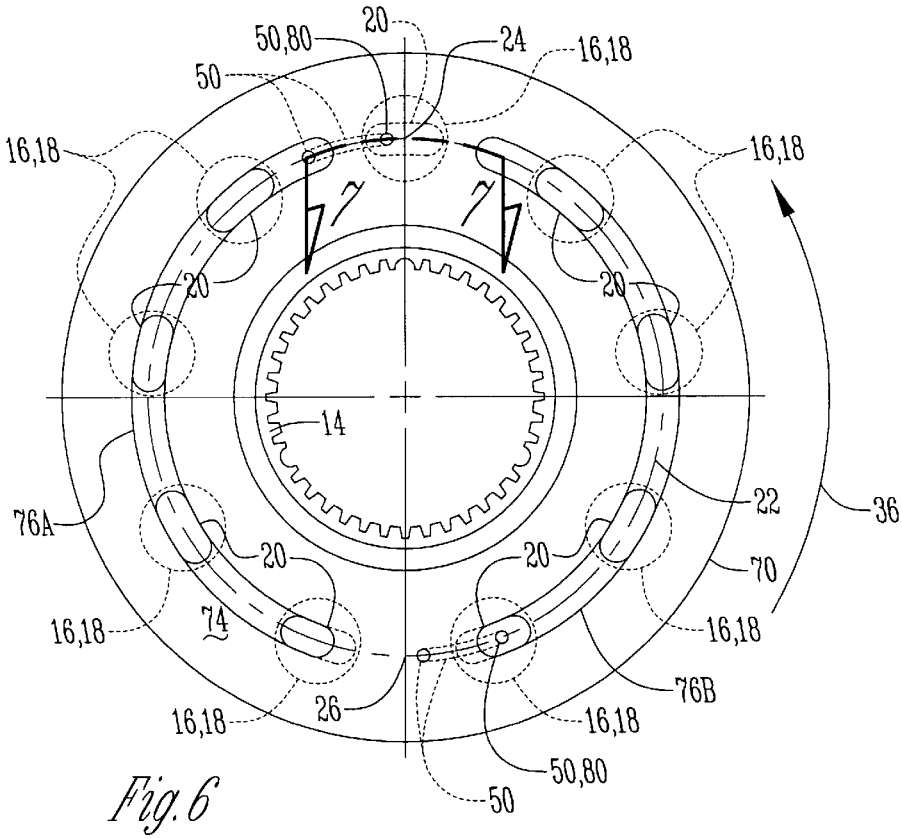
FIG. 6 is a plan view similar to FIG. 1 but shows the bottom of the valve plate and cylinder block of a second embodiment of this invention.
Figure 7:
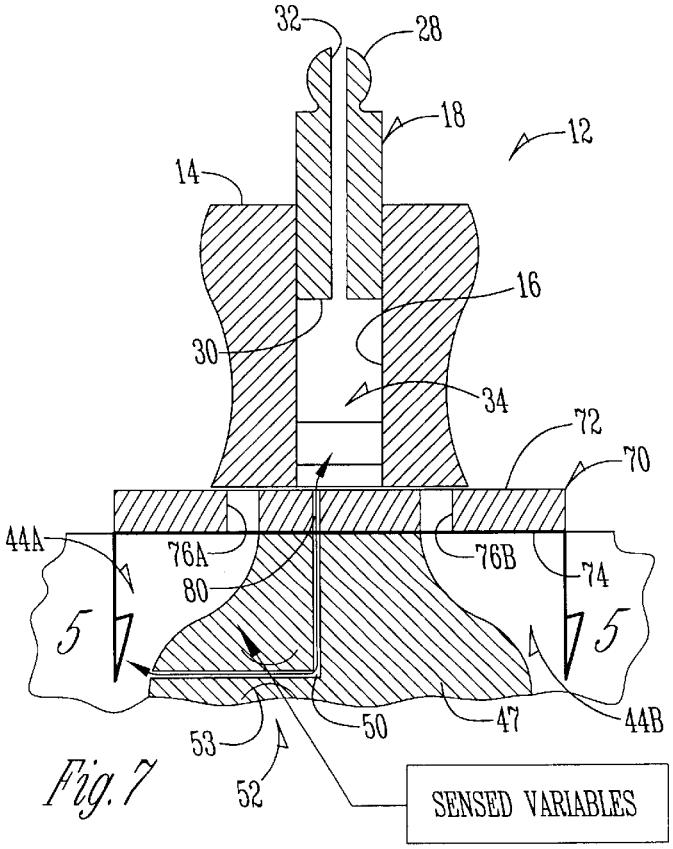
FIG. 7 is a sectional view similar to FIG. 2 but includes the optional valve plate located between the end cap and cylinder block in the second embodiment of this invention.

A second embodiment of the invention, which is useful when the displacement and working pressure requirements of the hydrostatic unit are relatively high, is shown in FIGS. 6–7. In this embodiment, a vale plate 70 detachably mounts between the sealing surface 38 of the cylinder block 14 and the block mounting surface 40 of the end cap 42. The valve plate 70 is preferably a substantially flat annular plate having a first surface 72 directed toward the cylinder block sealing surface 38 and a second surface 74 directed toward the block mounting surface 40 of the end cap 42. The valve plate 70 has a plurality (preferably a pair) of separate ports 76A, 76B that extend therethrough in axial direction. The ports 76A, 76B shown in FIG. 6 are generally referred to as inlet and outlet ports. The inlet and outlet ports 76A, 76B are arcuate and reside along arcs that generally align with the pitch circle 22 of the piston bores 16 in the cylinder block 14. Thus, the inlet and outlet ports 76A, 76B generally register with the ports 46A, 46B and the circular path of the reciprocating pistons 18 as the pistons rotate with the cylinder block 14. The cylinder block 14 rotates against the surface 72 of the valve plate 70. The valve plate 70 is detachably mounted or preferably pinned to the end cap 42 in a conventional manner so that it remains stationary with the end cap 42 as the cylinder block 14 rotates against it. The inlet and outlet ports 76A, 76B are angularly spaced apart in the transition areas or zones where the reciprocating pistons 18 change their direction of reciprocal movement or transition from high pressure to low pressure or vice versa.

Intervening walls 77, 78 of material exist between the adjacent ports 76A, 76B of the valve plate 70. A fluid passage 80 extends axially through at least one of the walls 77, 78 between the inlet and outlet ports of the valve plate. Like the bleed passage 50 in the end cap 42, the fluid passage 80 through the valve plate 70 preferably has a round cross section for ease of manufacturing; however, other shapes will suffice. The fluid passage 80 is in fluid communication with, preferably registered with, the bleed passage 50, the block kidney 20 and the path of the piston bore 16 of the cylinder block 14. the effective size of the fluid passage 80 should be sufficient so as not to limit flow of fluid into the bleed passage 50. For symmetrical impact on operating characteristics, it is preferred that a second fluid passage be formed through the valve plate near the bottom dead center position, as shown in FIG. 6.

As discussed in our co-pending application Ser. No. 09/776,554, the complete specification of which is incorporated herein by reference, the bleeding of fluid to or from the fluid pressure chambers 34 of the pistons 18 in the transition areas alters the pressure profile in the cylinder block piston bore. One consequence is a change in the force and energy levels required to position the swashplate. The present invention provides a method of adjusting swashplate moments in a multiple piston hydrostatic unit. The steps of this method include: 1) providing a bleed passage 50 and a variable orifice in an end cap 42 of the unit so as to fluidly connect a leading piston and a trailing piston in an adjustable manner or to fluidly connect a transitioning piston with a low or high pressure source also in an adjustable manner; and 2) adjusting the size of the variable orifice with a control signal based on a sensed system variable. The sensed system variable can be one or more variables selected from a group of system variables or operating condition variables such as noise, vibration, power lever requirement, and efficiency, pressure, speed and swashplate angle of the hydrostatic unit.

Thus, it can be seen that the present invention at least satisfies its stated objectives.

The preferred embodiments of the present invention have been set forth in the drawings and specification, and although specific terms are employed, these are used in a generic or descriptive sense only and are not used for purposes of limitations. Changes in the form and proportion of parts, as well as in the substitution of equivalents, are contemplated as circumstances may suggest or render expedient without departing from the spirit and scope of the invention as further defined in the following claims.

What is claimed is:

1. A bore pressure optimization mechanism for a hydrostatic unit including a rotatable cylinder block assembly having a cylinder block with a sealing surface thereon in fluid communication with a plurality of pressurizable piston bores, the mechanism comprising:

an end cap including separate first and second working pressure passages therethrough terminating respectively at corresponding first and second ports on a block mounting surface directed toward the sealing surface of the cylinder block, the ports having opposite ends separated or spaced apart by at least a pair of walls;

at least one wall of at least a pair of walls having and encircling a bleed passage formed therethrough, the bleed passage extending from the block mounting surface to one of the first and second working pressure passages;

a variable orifice valve having a variable orifice disposed in the bleed passage of the end cap for metering fluid from one of the piston bores to one of the first and second working pressure passages in the end cap; and means for generating a control signal to the valve so as to adjust the size of the variable orifice based upon the control signal wherein a swashplate operatively associated with the cylinder block has a tilt angle which is free from moveable influence from the change of size of the variable orifice.

2. The mechanism of claim 1 wherein the valve is an electronically-operated solenoid valve.

3. The mechanism of claim 2 wherein the means for generating a control signal includes a sensor that generates a signal to the solenoid valve that is relayed to the valve and is based upon a sensed system variable of the hydrostatic unit.

4. The mechanism of claim 3 wherein the means for generating a control signal further includes a microcontroller connected to the valve and the sensor for processing the signal from a sensor and generating the control signal to the solenoid valve such that the control signal is that is proportional to the sensed variable.

5. The mechanism of claim 3 wherein the sensor is adapted to sense a system or operating condition variable selected from the group of noise, vibration, power level requirement, efficiency, pressure, speed, and swashplate angle of the hydrostatic unit.

6. The mechanism of claim 1 wherein another of the at least a pair of walls has and encircles a second bleed passage formed therethrough, the second bleed passage extending to the other of the first and second working pressure passages, a second variable orifice valve having a second variable orifice disposed in the second bleed passage, and means for generating a control signal to the second valve so as to adjust the size of the second variable orifice based upon the control signal.

7. The mechanism of claim 1 comprising:

a valve plate mounted and secured against rotation on the block mounting surface of the end cap, the valve plate slidingly engaging the sealing surface of the cylinder block;

the valve plate including a first working pressure port therethrough in fluid communication with the first working pressure passage, a second working pressure port therethrough in fluid communication with the second working pressure passage and spaced apart from the first arcuate working pressure port so as to define a pair of spaced transitional areas therebetween, and a fluid passage extending axially through the valve plate in one of the transitional areas, the fluid passage being in fluid communication with the bleed passage.

8. A bore pressure optimization mechanism for a hydrostatic unit including a rotatable cylinder block assembly having a cylinder block with a sealing surface thereon in fluid communication with a plurality of pressurizable piston bores, the mechanism comprising:

an end cap including separate first and second working pressure passages therethrough terminating respectively at corresponding first and second ports on a block mounting surface directed toward the sealing surface of the cylinder block, the ports having opposites ends separated or spaced apart by intervening walls;

one of the walls having and encircling a bleed passage formed therethrough the bleed passage extending from the block mounting surface to one of the first and second working pressure passages;

a variable orifice valve having a variable orifice disposed in the bleed passage of end cap for metering fluid from said one of the piston bores to one of the first and second working pressure passages in the end cap; and means for generating a control signal to the valve means so as to adjust the size of the variable orifice based upon the control signal wherein a swashplate operatively associated with the cylinder block has a tilt angle which is free from moveable influence from the change of size of the variable orifice.

9. The mechanism of claim 8 wherein the bleed passage connects the block mounting surface to the first working pressure passage.

10. A method of adjusting swashplate moments in a multiple piston hydrostatic unit comprising the steps of:

providing a variable orifice in an end cap of the unit so as to fluidly connect a leading piston and a trailing piston in an adjustable manner;

adjusting the size of the variable orifice connecting the leading piston and the trailing piston with a control signal based on a sensed system variable wherein the swashplate has a tilt angle which is free from moveable influence from the change of size of the variable orifice.

11. The method of claim 10 wherein the sensed system variable is selected from the group of noise, vibration, power level requirement, and efficiency of the hydrostatic unit.

* * * * *